US007116279B1

(12) United States Patent
Chan et al.

(10) Patent No.: US 7,116,279 B1
(45) Date of Patent: Oct. 3, 2006

(54) LIGHTED ANTENNA

(75) Inventors: Yat-To Chan, Pingjhen (TW); Tze-Chung Wan, Taoyuan (TW)

(73) Assignee: Joymax Electronics Co., Ltd., Jhongli (TW)

( * ) Notice: Subject to any disclaimer, the term of this patent is extended or adjusted under 35 U.S.C. 154(b) by 18 days.

(21) Appl. No.: 11/104,023

(22) Filed: Apr. 12, 2005

(51) Int. Cl.
*H01Q 1/06* (2006.01)
*F21V 21/00* (2006.01)

(52) U.S. Cl. ..... 343/721; 362/397

(58) Field of Classification Search ..... 343/721, 343/702, 700 MS; 315/34, 111; 362/397, 362/191, 233
See application file for complete search history.

(56) References Cited

U.S. PATENT DOCUMENTS 6,225,956 B1 * 5/2001 Bradley ..... 343/721
6,275,045 B1 * 8/2001 Eloy ..... 324/639
6,292,151 B1 * 9/2001 Wu ..... 343/721
6,380,909 B1 * 4/2002 Wilkinson et al. ..... 343/890
7,044,622 B1 * 5/2006 Marshall ..... 362/397
2001/0017523 A1 * 8/2001 Van Den Nieuwenhuizen et al. ..... 315/34
2004/0046698 A1 * 3/2004 Martin et al. ..... 343/700 MS

* cited by examiner

*Primary Examiner*—Trinh Dinh
*Assistant Examiner*—Huedung Cao Mancuso

(57) ABSTRACT

A lighted antenna is provided. The lighted antenna is composed of an antenna pole, a base block, a cylindrical body, a control circuit, and a battery. The base block has a hole in the center for fixing the antenna in upright position, and a plurality of clipping holes surrounding center hole. The cylindrical body has a plurality of cylinder clips formed along the circular rim on one end, corresponding to the positions of the clipping holes. A plurality of light-emitting diodes are installed inside the base block and positioned directly below respective clipping holes. The cylindrical body is attached onto the base block by press fitting the cylinder clips into respective clipping holes. Whenever the antenna is activated, light is projected onto the antenna surface with inclined angle, passing through unblocked portion of clipping holes, to produce flashing light.

5 Claims, 2 Drawing Sheets

LIGHTED ANTENNA

BACKGROUND OF THE INVENTION

1. Field of the Invention

The present invention relates to a lighted antenna, and in particular to an antenna set having built-in light source that is capable of producing a flashing light, especially at night-time, whenever the antenna is activated.

2. The Related Art

Nowadays, electronic products not only require technological innovation, but also have to be aesthetically pleasing to the users.

For example, many of the features on notebook computers are fairly standardized, so vendors now turn their attention to the external forms and fresh icons. Some of them use aluminum alloy casing in an effort to enhance a user's impression, while others introduce mirror-like reflection titanium plated casing. Still others use silver plating, vibrant color combinations, or fluorescent materials to highlight their stylish casings.

All these efforts are intended to appeal to those shoppers who are looking for something special in the line of computer equipment that usually gives people an ice-cold feeling.

But the user's curiosity about the fresh icons would not last for too long. As the user is gradually acclimatized to the once interesting icon, the initial enthusiasm starts to wear off. A better approach is to create a dynamically changing icon instead of a static icon. For example, a flashing light that is synchronized with the operation of the host machine can fit in such design concept.

SUMMARY OF THE INVENTION

The primary object of the present invention is to provide an antenna with built in light source that is able to light up the antenna whenever the antenna is activated, thus creating a dynamic visual effect for the user.

In accordance with the invention, the architecture of the lighted antenna includes an antenna pole, a base block, a cylindrical body, a light source, a control circuit and a battery. The top surface of the base block has a center hole and a plurality of clipping holes surrounding the center hole. The center hole is used to fix the antenna pole in upright position. The cylindrical body has a plurality of cylinder clips on one end, formed along the circular rim, corresponding to the positions of the clipping holes. The light source is composed of a plurality of light-emitting diodes that are installed inside the base block and positioned directly below the clipping holes. The total number of cylinder clips shall equal that of the clipping holes.

In accordance with the invention, the antenna is suitable for all kinds of wireless applications, such as notebook wireless communication devices, remote-controlled devices, and others. The antenna set enables the wireless communication device to establish point-to-point or multi-point connections with other devices through wireless communication.

The cylindrical body can be manually attached onto the base block by press fitting the cylinder clips into corresponding clipping holes. To do so, firstly the cylindrical body is held in upright position over the base block, with all cylinder clips and clipping holes properly aligned, and then a little force is applied to push the upper end of the cylindrical body down to allow the cylinder clips to be inserted into respective clipping holes, and then the antenna is assembled.

When the cylindrical body is assembled on the base block, each clipping hole is partly blocked by a respective cylinder clip, in such a manner that a larger portion of the hole, closest to the perimeter of the base block, is occupied by the cylinder clip, and a smaller portion of the hole, behind the cylinder clip and closest to the center of the base block, is left unblocked with an open gap.

In accordance with the present invention, whenever the antenna is activated, light-emitting diode lights are able to pass through the open gaps behind the clips, which are then projected onto the antenna surface with inclined angle, so that a flashing light antenna can be observed by the PC user.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1A:
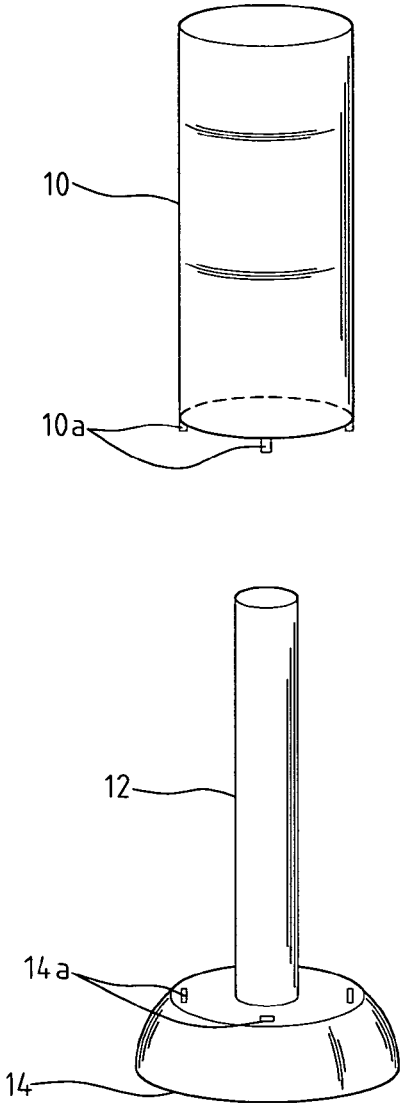
FIG. 1A is an exploded view of the present invention.
Figure 1B:
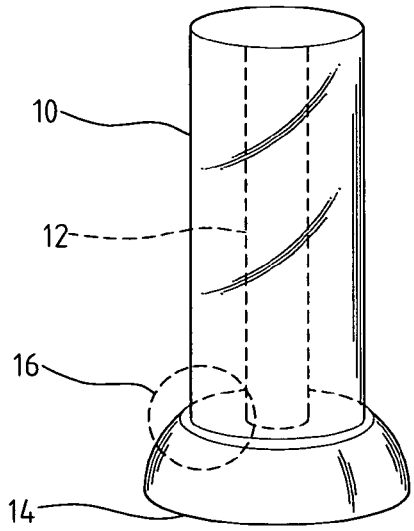
FIG. 1B is an isometric view of an assembled in accordance with the present invention.

Referring to FIGS. 1A and 1B, the lighted antenna is composed of a cylindrical body 10, an antenna pole 12, a base block 14, as well as a light source 18, a control circuit, and a battery, which are hidden inside the base block (not shown). The bottom of the antenna pole 12 is connected by a signal cable (not shown) leading to a wireless communication device (not shown).

The base block 14 as shown in FIG. 1A has a center hole (not shown) and a plurality of clipping holes 14*a* around the outer edge of the top surface. The center hole is used to fix the antenna pole 12 in upright position, while the clipping holes 14*a* are to receive cylinder clips 10*a* of the cylindrical body 10.

The light source 18 includes a plurality of light-emitting diodes installed inside the base block 14 and positioned directly below the clipping holes 14*a*.

The cylindrical body 10 is transparent and made of resin material. A plurality of cylinder clips 10*a* are formed around the circular rim on one end of the cylindrical body 10, corresponding to respective clipping holes 14*a* on the base block 14. The cylindrical body 10 is manually attached onto the base block 14 by press fitting the cylinder clips 10*a* in corresponding clipping holes 14*a*.

Figure 2A:
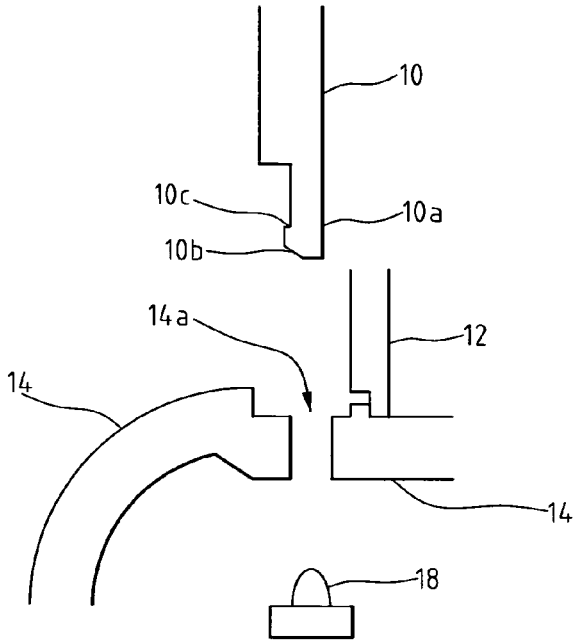
FIG. 2A is a diagram showing the structure of a cylinder clip before the cylinder clip is inserted into the hole (a sectional view of part of the antenna set originally shown in FIG. 1B by the dotted line circle)
Figure 2B:
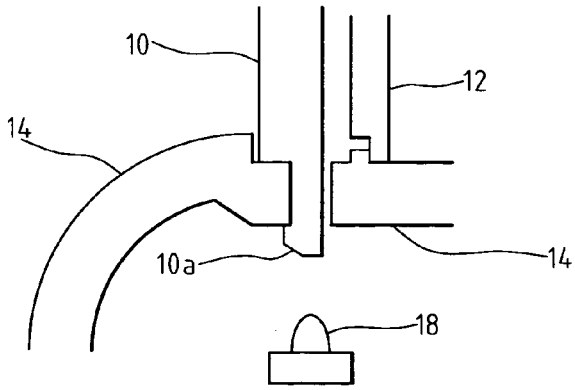
FIG. 2B is another diagram showing the cylinder clip being inserted into the hole with a light source disposed directly below the hole.

Referring to FIGS. 2A and 2B, the structure of one cylinder clip 10 is shown by the sectional view of part of the antenna set, originally shown in FIG. 1B by the dotted line circle 16. Each cylinder clip 10*a* is made of resin material, and has a flexible pin 10*a* with a beveled portion 10*b* and a right-angled cut portion 10*c* at the head.

When the tip of the flexible pin 10*a*, that is the beveled portion 10*b*, thrusts against the edge of the clipping hole 14*a*, the flexible pin 10*a* is slightly deflected to allow the beveled portion 10*b* to push through the clipping hole 14*a*, and then after the beveled portion 10*b* and right-angled cut portion 10*c* passed through the clipping hole 14*a*, the flexible pin 10*a* is restored to the original position, thus the cylinder clip 10*a* is engaged in the clipping hole 10*a*.

To assemble the antenna set, firstly, the cylindrical body 10 is held in upright position over the base block 14 with all cylinder clips 10*a* and clipping holes 14*a* aligned, and then a little force is applied on the upper end of the cylindrical body 10 to push respective cylinder clips 10*a* down into clipping holes 14*a*. When all cylinder clips 10*a* are engaged in the clipping holes 14*a*, the cylindrical body 10 is successfully assembled on the base block 14.

When the cylindrical body 10 is assembled on the base block 14, each clipping hole 14*a* is partly blocked by a respective cylinder clip 10*a*, in such a manner that a larger portion of the hole 14*a*, closest to the perimeter of the base block 14, is occupied by the cylinder clip 10*a*, and a smaller portion of the hole 14*a*, behind the cylinder clip 10*a* and closest to the center of the base block 14, is left unblocked with an open gap.

The light source 18 includes a plurality of light-emitting diodes 18, which are installed inside the base block 14 and respectively positioned directly below the clipping holes 14*a*.

The design of the control circuit is very similar to other conventional light flashers, wherein the control circuit is connected to all light-emitting diodes, and is also connected to the battery unit.

Whenever the antenna is activated, light-emitting diode lights are projected onto the antenna surface 12 with inclined angle, through the unblocked portion of clipping holes (not numbered), to produce flashing light antenna.

Alternatively, the surface of the antenna pole 12 can be decorated with different color patterns, so colorful light will be displayed to further enhance the visual effect.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A lighted antenna, comprising:

an antenna pole;

a cylindrical body having a plurality of cylinder clips on one end;

a base block having a center hole for fixing the antenna pole in upright position and a plurality of clipping holes surrounding the center hole, corresponding to the cylinder clips; and a light source arranged inside the base block;

wherein the cylinder clips are press fit into the clipping holes to have the cylindrical body attached onto the base block;

wherein, whenever the antenna is activated, light is projected onto the antenna surface with inclined angle, passing through the unblocked portions of clipping holes, to create a flashing light.

2. The lighted antenna as claimed in claim 1, wherein the cylindrical body is transparent and made of resin material.

3. The lighted antenna as claimed in claim 1, wherein the light source comprises a plurality of light-emitting diodes positioned below respective clipping holes.

4. The lighted antenna as claimed in claim 1, wherein the surface of the antenna pole is decorated with multi-color patterns.

5. The lighted antenna as claimed in claim 1, wherein the antenna has a bottom connected by a signal cable leading to a wireless communication device.

* * * * *